US010438724B2

(12) United States Patent
Dettmer et al.

(10) Patent No.: US 10,438,724 B2
(45) Date of Patent: Oct. 8, 2019

(54) DATA CABLE

(71) Applicant: LEONI KABEL GMBH, Nuremberg (DE)

(72) Inventors: Melanie Dettmer, Heede (DE); Bernd Janssen, Friesoythe ot Neuscharrel (DE)

(73) Assignee: LEONI Kabel GmbH, Nuremberg (DE)

( * ) Notice: Subject to any disclaimer, the term of this patent is extended or adjusted under 35 U.S.C. 154(b) by 0 days.

(21) Appl. No.: 15/333,391

(22) Filed: Oct. 25, 2016

(65) Prior Publication Data

US 2017/0103830 A1 Apr. 13, 2017

Related U.S. Application Data

(63) Continuation of application No. PCT/EP2015/059078, filed on Apr. 27, 2015.

(30) Foreign Application Priority Data

Apr. 25, 2014 (DE) ..... 10 2014 207 879

(51) Int. Cl.
*H01B 11/06* (2006.01)
*H01B 11/00* (2006.01)
*H01B 11/20* (2006.01)

(52) U.S. Cl.
CPC ..... *H01B 11/002* (2013.01); *H01B 11/203* (2013.01)

(58) Field of Classification Search
CPC ..... H01B 11/06; H01B 7/18
USPC ..... 174/106 R, 108, 109, 113 R
See application file for complete search history.

(56) References Cited

U.S. PATENT DOCUMENTS 2,152,706 A * 4/1939 Mougey ..... H01B 11/08 174/103
2,691,698 A * 10/1954 Schmidt ..... H01B 7/328 174/102 R
3,588,317 A * 6/1971 Hutchins, Jr. ..... H01B 11/1025 174/106 R
3,927,247 A * 12/1975 Timmons ..... H01B 11/1808 174/107
4,096,346 A * 6/1978 Stine ..... B29C 47/128 174/110 AR (Continued)

FOREIGN PATENT DOCUMENTS

CN 201616295 U 10/2010
CN 102231299 A 11/2011

(Continued)

*Primary Examiner* — Chau N Nguyen
(74) *Attorney, Agent, or Firm* — Laurence A. Greenberg; Werner H. Stemer; Ralph E. Locher

(57) ABSTRACT

A data cable for high-speed data transmission at signal frequencies of >10 GHz includes at least one core pair which is surrounded by a film-shaped pair shield having an inner shielding film and an outer shielding film which, are in electrical contact with one another and in which the inner shielding film is wound around the core pair. By virtue of this measure, an undesired resonance effect is avoided which, in previously wound pair shields, has not allowed use for relatively high signal frequencies. At the same time, an undesired common-mode signal, which would occur in the case of a longitudinally folded shielding film, is thus suppressed.

16 Claims, 3 Drawing Sheets

(56) References Cited

U.S. PATENT DOCUMENTS

| | | | | |
|---|---|---|---|---|
| 5,434,354 | A * | 7/1995 | Baker | H01B 11/1025 174/106 R |
| 6,583,361 | B2 * | 6/2003 | Clouet | H01B 11/183 174/108 |
| 6,677,518 | B2 * | 1/2004 | Hirakawa | H01B 11/002 174/36 |
| 6,894,226 | B2 * | 5/2005 | Yokoi | H01B 11/183 174/102 R |
| 6,984,788 | B2 * | 1/2006 | Grogl | H01B 7/1895 174/106 R |
| 8,143,522 | B2 * | 3/2012 | Laudenslager | H01B 11/085 174/110 R |
| 8,444,430 | B2 | 5/2013 | Kappla et al. | |
| 8,536,450 | B2 * | 9/2013 | Aumoitte | H01B 9/028 174/36 |
| 8,556,646 | B2 | 10/2013 | Kappla et al. | |
| 8,653,373 | B2 | 2/2014 | Sugiyama et al. | |
| 9,484,127 | B2 | 11/2016 | Sugiyama et al. | |
| 2004/0245009 | A1 | 12/2004 | Grogl et al. | |
| 2009/0260847 | A1 | 10/2009 | Tobben et al. | |
| 2010/0101853 | A1 | 4/2010 | McNutt et al. | |
| 2012/0145429 | A1 | 6/2012 | Nordin et al. | |
| 2013/0248221 | A1 | 9/2013 | Booth et al. | |
| 2014/0027151 | A1 * | 1/2014 | Huang | H01B 7/17 174/109 |
| 2016/0294122 | A1 | 10/2016 | Janssen et al. | |

FOREIGN PATENT DOCUMENTS

| | | | |
|---|---|---|---|
| CN | 203422943 | U | 2/2014 |
| CN | 103646687 | A | 3/2014 |
| DE | 102013225794 | A1 | 6/2015 |
| EP | 2112669 | A2 | 10/2009 |
| JP | 2003229028 | A | 8/2003 |
| JP | 2004087189 | A | 3/2004 |
| JP | 2010218740 | A | 9/2010 |
| JP | 2012169251 | A | 9/2012 |
| JP | 2012169265 | A | 9/2012 |
| JP | 2012238468 | A | 12/2012 |
| JP | 2013254730 | A | 12/2013 |
| JP | 2014-017131 | * | 1/2014 |
| WO | 2011072869 | A1 | 6/2011 |
| WO | 2011089003 | A1 | 7/2011 |

* cited by examiner

DATA CABLE

CROSS-REFERENCE TO RELATED APPLICATION

This is a continuation application, under 35 U.S.C. § 120, of copending International Application PCT/EP2015/059078, filed Apr. 27, 2015, which designated the United States; this application also claims the priority, under 35 U.S.C. § 119, of German Patent Application DE 10 2014 207 879.2, filed Apr. 25, 2014; the prior applications are herewith incorporated by reference in their entirety.

BACKGROUND OF THE INVENTION

Field of the Invention

The invention relates to a data cable for high-speed data transmissions having at least one core pair including two cores which are surrounded by a film-like or film-shaped pair shield.

A data cable of that type is known, for example, from European Patent Application EP 2 112 669 A2, corresponding to U.S. Patent Application US 2009/0260847.

In the field of data transmission, for example in computer networks, data cables are used for data transmission, in which a plurality of data lines are typically combined in a common cable sheath. For high-speed data transmissions, shielded core pairs are used as data lines, wherein the two cores are specifically routed in parallel or, alternatively, are twisted together. Each core includes an independent conductor, for example a solid conductor wire or a stranded wire, each of which is surrounded by insulation. The core pair of a respective data line is surrounded by a (pair) shielding. The data cable is typically formed of a plurality of shielded core pairs of that type, which form a conductive core and are surrounded by a common outer shielding and by a common cable sheath. Data cables of that type are used for high-speed data links, and are constructed for data transmission rates in excess of 5 Gbit/s, specifically at frequencies exceeding 14 GHz. The outer shielding is significant with respect to both EMV and EMI properties, and carries no signals. Conversely, the respective pair shield dictates both the symmetry and the signal properties of a respective core pair.

Data cables of that type are typically "symmetrical data lines," in which the signal is transmitted through one core, and the inverted signal is transmitted through the other core. The differential signal component between those two signals is evaluated, in such a way that external effects, which impact upon both signals, are eliminated.

In many cases, data cables of that type are prefitted to connectors. In applications for high-speed transmissions, connectors are frequently configured as "small form pluggable" connectors, or "SFP" connectors for short. A number of variants in execution are available for that purpose, including "SFP−", "SFP+" or "CXP-QSFP" connectors. Those connectors are provided with special connector housings, which are known, for example, from International Publication WO 2011 072 869 A1, corresponding to U.S. Pat. No. 8,444,430 or International Publication WO 2011 089 003 A1, corresponding to U.S. Pat. No. 8,556,646. Alternatively, a direct "back plane" connection or connector is also possible.

In their interior, connector housings of that type incorporate a printed circuit board or card, which is partially provided with integrated electronics. On the reverse side of the connector, the respective data cable is to be connected to that card. To that end, the individual cores of the data cable are soldered or welded to the card. The opposite end of the card is typically configured as a connecting tab with connecting contacts, which is plugged into a mating connector. Cards of that type are also described as "paddle cards".

In that configuration, the pair shielding of a respective core pair, as is known, for example, from European Patent Application EP 2 112 669 A2, corresponding to U.S. Patent Application US 2009/0260847, is configured as a longitudinally folded shielding film. The shielding is consequently folded around the core pair in a longitudinal direction of the cable, wherein the two ends overlap in a longitudinally-oriented overlap zone. The shielding film used for shielding purposes is a multi-layer shielding film, formed of at least one conductive (metal) layer and an insulating layer. An aluminum layer is customarily employed as the conductive layer, and a PET film as the insulating layer. The PET film is configured as a substrate, to which a metal coating is applied for the formation of the conductive layer.

In addition to the longitudinally folded shielding of parallel pairs, the option is available, in principle, for the helical winding of a shielding film of that type around the core pair. However, at higher signal frequencies, in excess of approximately 15 GHz, for structural reasons, any such braiding of the core pair with a shielding film is not possible without further measures, on the grounds of resonance effects. At those high frequencies, the shielding film is therefore applied as a longitudinally folded film.

A longitudinally applied film of that type, however, is associated with unwanted and negative secondary effects. Longitudinally folded shielding does not provide adequate damping of the "common mode signal," also described as the in-phase signal, of the type associated with the application of a braided shielding film.

The generation of the common mode signal or in-phase signal in symmetrical lines of that type with parallel pairs is known, in principle. Moreover, the damping of the unwanted common mode signal is handicapped, in that the common mode signal component is generally propagated more rapidly than the differential signal component, which is of practical value. The absent or severely reduced damping of that common mode signal, in comparison with braided core pairs, therefore results in the impairment of "skew" or of "mode conversion performance."

In high-speed data connections of that type, the objective is generally an increase in transmission capacity. Data transmission rates, and consequently the frequency range of data cables of that type are constantly increasing, with an associated increase in problems associated with common mode signal components.

SUMMARY OF THE INVENTION

It is accordingly an object of the invention to provide a data cable, which overcomes the hereinafore-mentioned disadvantages of the heretofore-known cables of this general type and which achieves improved data transmission in a high-speed data link of this type, at high signal frequencies in excess of 10 GHz.

With the foregoing and other objects in view there is provided, in accordance with the invention, a data cable configured for high-speed data transmissions, comprising at least one, and preferably a plurality of core pairs of two longitudinally-extending cores, in which each core pair is surrounded by a respective film-like or film-shaped pair shield. The pair shield has a first inner shielding film and a second outer shielding film and the inner shielding film is wound around the core pair. The two shielding films are in mutual electrical contact.

The consideration informing this construction is the combination of the benefits of a helically-wound pair shielding with those of a longitudinally folded pair shielding. This construction employs the knowledge that resonance effects associated with a helically-wound pair shielding at high signal frequencies are generated by the circumstance whereby, in a conventionally wound pair shielding, which is customarily multi-layered, the two conductive layers of the wound shielding are mutually insulated in the overlap zone, thereby forming a capacitor. Simultaneously, the helical winding forms a coil in such a way that, overall, an oscillating circuit with a predefined resonant frequency is constituted, which cannot be displaced to a higher frequency band by structural measures associated with a conventional construction.

Due to the configuration of pair shielding in two layers, which are electrically interconnected, the formation of an oscillating circuit of this type can be reliably suppressed on the grounds that, as a result of the electrical connection, no coil-type winding is present, and the coil is thus virtually short-circuited. The resonant frequency is the root of (1/(L*C)). Since the inductance is also reduced, at least to a significant degree, the resonant frequency can easily be set to values in excess of 15 GHz. Conversely, this resonant or critical frequency in conventional metal film braidings, depending upon geometry, is subject to an upper limit on the order of 15 GHz. Accordingly, the basic concept of a longitudinally folded pair shielding can be adopted, at least with respect to its functional result. At the same time, winding, preferably with overlapping, permits the reliable suppression of the disadvantage of a longitudinally folded pair shielding, namely, the high common mode signal. Overall, therefore, the pair shielding described herein, which is constituted of the two shielding films, permits the achievement of effective shielding, with no disruptive secondary effects. Resonance effects, and the correspondingly high damping of the signal, together with the inadequate damping of the common mode signal, specifically in case of the overlapping of the inner shielding film, are effectively prevented. In comparison with a longitudinally folded film, this construction is distinguished by simpler construction, superior symmetry and enhanced (bending) flexibility.

The cores in each respective core pair are thus specifically configured in a mutually parallel configuration, and are consequently not twisted.

The inner shielding film is appropriately wound around the core pair in an overlapping configuration. The desired damping of the common mode signal is reliably and advantageously achieved by overlapping.

According to a first variant, only a small overlap is provided. The overlap is preferably on the order of less than 20%, specifically less than 10%, and more specifically less than 5% of the width of the inner shielding film. This figure lies, for example, within the range of 1% to 5%. The width of the shielding film is typically on the order of 4 to 6 mm. The width of the overlap zone of the inner shielding film therefore ranges from 0 to a maximum of 0.6 mm, and the maximum overlap is therefore specifically on the order of 10%. Preferably, it is lower than this. Investigations have shown that a small overlap of this type is still sufficient for the achievement of the desired properties. In comparison with a large overlap, this configuration is associated with a higher frequency range (>20 GHz). The common mode signal is also at least partially damped. This variant provides the advantage of an exceptionally high flexibility of the data cable, together with a high degree of symmetry.

According to a second variant, conversely, a comparatively large overlap is provided, within the range of 20% to 40%. In this variant, in comparison to the variant with the small overlap, a lower critical frequency is achieved. Simultaneously, however, the damping of the common mode signal component is improved, i.e. the unwanted signal component is suppressed more effectively. Investigations have also shown that the second outer shielding film permits an accurate setting of the resonant frequency, in such a way that a useful frequency band of e.g. up to exactly 20 GHz can be achieved.

As an alternative to an overlapped winding, the inner shielding film can be wound around the core pair with no overlap, and specifically with no gaps, i.e. in a butt-jointed configuration. This permits the more reliable suppression and exclusion of capacitor effects. At the same time, a gap-free winding ensures the reliable provision of fully-enclosed shielding. In this case, this is ensured by the second outer shielding film, even in the event of bending.

Appropriately, at least one and preferably both shielding films are configured in multiple layers, with a conductive layer and a non-conductive substrate. The two shielding films are thus specifically configured as "Al-PET" films. The outer film can, in principle, also be configured as a metal film, or as an Al-PET—Al-film, i.e. with a substrate, to which a conductive layer is applied on both sides. In the interests of effective electrical bonding, the two shielding films are configured with their conductive layers or sides in a mutually inward-facing configuration.

Moreover, it is appropriately provided that the outer shielding film is likewise wound, specifically in the opposing direction to the inner shielding film. This permits the reliable achievement of effective electrical contacting and the bridging of butt joints in the inner shielding film. The pair shielding can thus be described as a double-wound helical pair shielding.

According to a first variant, the outer shielding film is thus preferably wound at least in a butt-jointed configuration, and particularly with an overlap, in such a way that a closed shielding layer is formed.

According to a specifically preferred further development, the outer shielding film is wound in a gapped configuration, i.e. adjoining turns of the winding are disposed with a mutual longitudinal clearance. The clearance, and thus the gap, is preferably on the order of only a few percent, for example between 1 and 10% of the width of the shielding film. This variant of execution is preferably applied in combination with the winding of the inner shielding film with a large overlap (20-40% of the width thereof). Due to this specific selection of the configuration and winding of the second shielding film, the accurate setting of the resonant frequency can be achieved. Moreover, the advantage of particularly effective common mode damping is maintained.

Moreover, at least one sheath wire is preferably provided, and bonded in an electrically conductive configuration to at least one, and preferably to both shielding films. A sheath wire of this type ensures, for example, the secure electrical contacting of the pair shielding to a contact element, for example to a connector. According to a first variant, this sheath wire is disposed between the two shielding films, and is specifically oriented in parallel to the individual cores, for example in an intermeshing area. According to a second variant, the sheath wire is bonded to the exterior of the outer shielding film. Preferably, in general, two sheath wires are disposed symmetrically to a plane of symmetry of the core pair. In the case of the outer sheath wire, it is disposed on the connection axis of the two conductors in the core pair.

Moreover, in an appropriate further development, a fixing film is also wound around the pair shielding of a respective core pair. Specifically, this is an adhesive film, which is adhered to the pair shielding. The shielding structure of the pair shielding is secured accordingly. The fixing film is specifically an insulating film, such that each pair shielding is provided with exterior electrical insulation, specifically e.g. in relation to a common outer shielding.

In general, in a preferred configuration, the data cable has a core assembly or cable core formed of a plurality of electrically conductive components, wherein at least one, and preferably a plurality of the conductors are constituted by the core pair which is provided with the pair shielding.

Appropriately, the cable core is formed exclusively of core pairs of this type. Moreover, the cable core is surrounded by a common outer shielding. This is specifically configured in a multi-layer configuration. The constituents thereof, according to preference or in combination, may be a braided shielding or shielding films, specifically metal-plated films, etc. In turn, an outer cable sheathing is customarily disposed around the outer shielding.

In the configuration described herein, the data cable, and specifically the pair shielding, are appropriately constructed for the exceptionally effective contact bonding of the pair shielding to a printed circuit board in a typical connector (small form pluggable SFP+, SFP28, QSFP28, etc.) for high-speed data transmission (or "paddle card"). German Patent Application DE 10 2013 225 794 A1, corresponding to U.S. Patent Application US 2016/0294122, describes a preferred form of contact bonding of this type. In the assembled state, the data cable is therefore connected to a connector of this type.

Other features which are considered as characteristic for the invention are set forth in the appended claims.

Although the invention is illustrated and described herein as embodied in a data cable, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
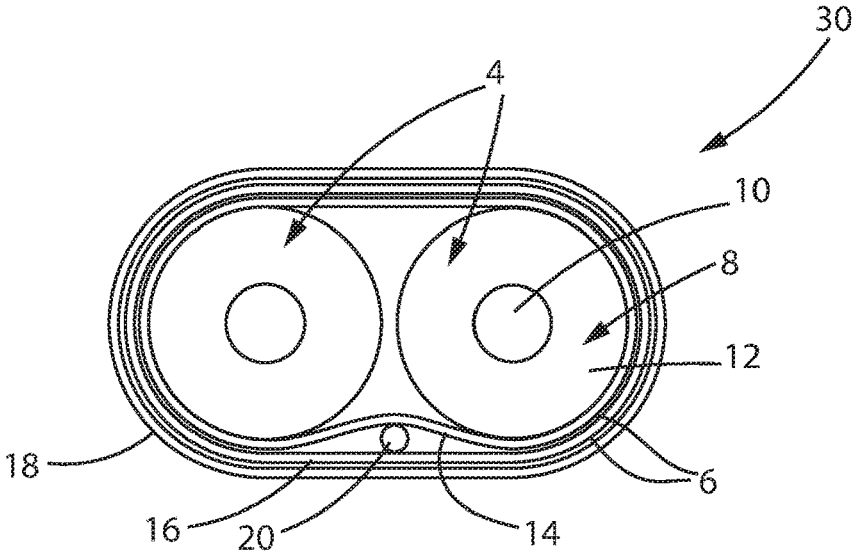
FIG. 1 is a diagrammatic, cross-sectional view of a core pair, fitted with a pair shielding.

Referring now in detail to the figures of the drawings, in which components of equivalent function are identified by the same reference numbers, and first, particularly, to FIG. 1 thereof, there is seen a core pair 4 for use in a high-speed data cable 2 (see FIGS. 4 and 5), with a pair shielding 6. The core pair 4 in this case includes two cores 8, each of which in turn includes a central conductor 10, which is surrounded by insulation 12. The conductor 10 is customarily a solid conductor. Alternatively, stranded wires can also be used.

The two cores 8 are preferably configured in a mutually parallel configuration, and are consequently not twisted together.

The core pair 4 as a whole is surrounded by a multi-layered pair shielding, which includes an inner shielding film or foil 14 and an outer shielding film or foil 16. Specifically, these two shielding films 14, 16 form a closed configuration of the pair shielding 6. Finally, the pair shielding 6 is enclosed and is specifically wound within a fixing film or foil 18, which is specifically configured as an adhesive film. The fixing film 18 is formed of plastic, and is electrically non-conductive, and thus electrically insulating.

Additionally, FIG. 1 includes an exemplary representation of an optional sheath wire 20, which is preferably disposed in an intermeshing zone of the two cores 8. The sheath wire 20 is moreover specifically disposed between the two shielding films 14, 16. Alternatively, two sheath wires 20 are preferably externally bonded to the outer shielding film 16, as represented e.g. in FIG. 5. The two sheath wires 20 are disposed on an imaginary plane of symmetry or connecting line of the two conductors 10. In the event of the external positioning of the at least one sheath wire 20, the latter is therefore specifically held between the outer shielding film 16 and the fixing film 18.

The core pair 4, together with the pair shielding 6 and the fixing film 18 and, where applicable, the sheath wires 20, are also described hereinafter as a shielded pair 30.

The two shielding films 14, 16 are preferably each metal-coated plastic films, specifically "Al-PET" films. These films are each provided with a substrate 22, configured as an insulating layer, to which a conductive layer 24 is applied (see in this respect specifically FIG. 3). In the event of the external positioning of the sheath wires, the outer side of the outer shielding film 16 must also be configured as a conductive layer 24. The outer shielding film 16 is then, for example, a substrate 22 with conductive layers 24 applied to both sides, or a metal film which, in principle, has conductive layers 24 on either side.

The two shielding films 14, 16 are oriented in such a way that their respective conductive layers 24 are mutually inward-facing, and specifically are in mutual contact, in such a way that the two conductive layers 24 are bonded in an electrically conductive configuration.

Figure 2:
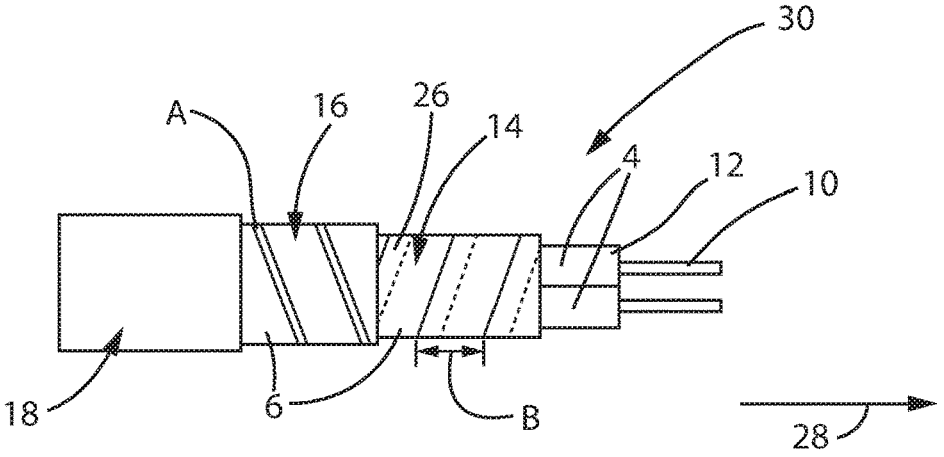
FIG. 2 is a side-elevational view of the core pair represented in FIG. 1.

As can be seen in FIG. 2, the inner shielding film 14 is helically wound around the core pair 4. The shielding film 14 is customarily wound with a very small pitch, i.e. in a very close-wound configuration. The smaller the pitch, the greater the displacement of the unwanted resonance effect to higher frequencies. Typically, the pitch is only a few mm, for example on the order of 2 to 6 mm, i.e. for each 360° winding, the shielding film advances by 2 to 6 mm in the longitudinal direction 28.

The inner shielding film 14 is wound with an overlap 26, in such a way that adjoining winding sections are mutually overlapped in the longitudinal direction 28. According to a preferred configuration, this overlap 26 is equal to approximately one third of the width B of the inner shielding film 14.

The outer shielding film 16 is also preferably wound, but in the opposite direction to the inner shielding film 14. The outer shielding film 16 is, for example, disposed with the same pitch as the inner shielding film 14. Alternatively, the pitch thereof differs from that of the latter and is, for example, smaller or even greater. The outer shielding film 16 can also be provided with an overlap, or can be wound in a butt-jointed configuration.

In a preferred configuration, however, a gapped winding is provided, in such a way that a clearance A is formed between two adjoining winding sections. The clearance A, for example, lies within the range of 1-5% of the width B of the outer shielding film 16.

The fixing film 18 is specifically a plastic substrate film, to which an adhesive layer is applied. This film is also preferably wound in a manner not shown in FIG. 2.

Figure 3:
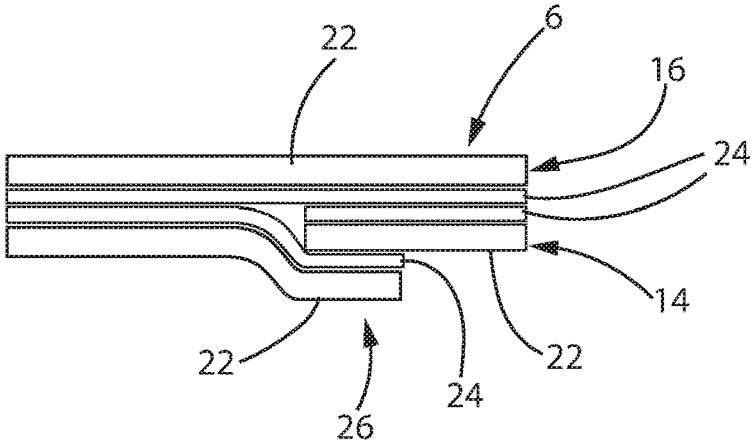
FIG. 3 is an enlarged, longitudinal-sectional view of the pair shielding in an overlap zone.

With reference to the enlarged sectional representation of the pair shielding 6 in an overlap zone shown in FIG. 3, it will be seen that the inner shielding film 14, in its mutually opposing edge zones, and consequently in the overlap zone 26, is disposed with the conductive layer 24 facing outwards. Therefore, the inner shielding film 14 is not enclosed at the edge zones. In the overlap zone 26, the inner shielding film 14 is thus disposed in an alternating sequence of the substrate 22 and the conductive layer 24. Accordingly, the edge zones of the conductive layer 24 of the inner shielding film 14 are separated in a mutually insulated manner in the overlap zone 26, thereby resulting in the above-mentioned oscillating circuit with the unwanted resonance effect whereby, specifically at higher frequencies in excess of 5 GHz, unwanted damping occurs as a result of the resonance effects. Due to the additional provision of the outer shielding film 16 described herein, these unwanted effects are at least reduced. At the same time, the overlap 26 selected in the exemplary embodiment shown in FIG. 3 damps the unwanted common mode signal.

Figure 4:
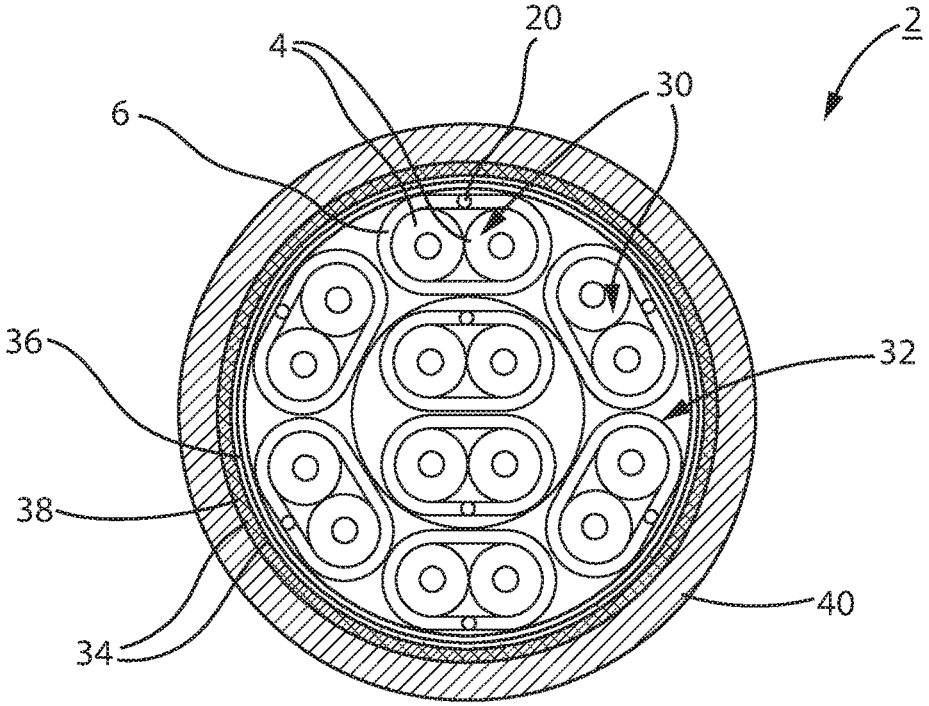
FIG. 4 is an enlarged, cross-sectional view of a data cable according to a first embodiment variant.
Figure 5:
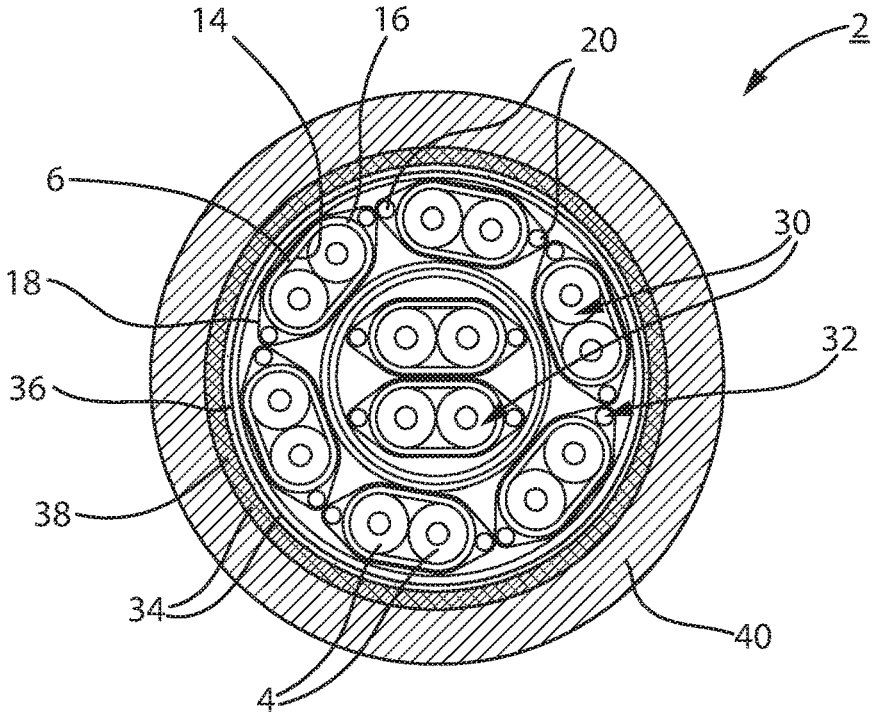
FIG. 5 is a cross-sectional view of a data cable according to a second embodiment variant.

Customarily, in a data cable 2, a plurality of conductors 30 are combined in a cable core 32, as represented in FIGS. 4 and 5. In both variants, each of the conductors includes a shielded pair 30. However, other types of conductors can also be incorporated.

The two variants of the data cable 2 represented in FIGS. 4 and 5 are mutually distinguished specifically with respect to the composition of the individual shielded pairs 30. In the variant represented in FIG. 4, shielded pairs 30 of the type described with reference to FIG. 1 are used.

In the variant represented in FIG. 5, an alternative embodiment is employed. In this case, two sheath wires 20 are disposed externally between the outer shielding film 16 and the fixing film 18.

In both variants it is preferred that two shielded pairs 30 are firstly wound in a plastic film, as represented in the exemplary embodiment. This core area is then circumferentially enclosed by a plurality of further shielded pairs 30. In the exemplary embodiment the further shielded pairs 30 are six in number.

These shielded pairs, and consequently the cable core 32, are preferably enclosed in a multi-layer sheathing configuration. In data cables 2 of this type, the cable core 32 is generally surrounded by a common outer shield 34. In the exemplary embodiment, an additional inner layer of plastic film is also wound around the cable core 32.

In the exemplary embodiment, the outer shield 34 is configured in a multi-layer configuration, including a combination of film or foil shielding 36 and, for example, braided shielding 38. Finally, this outer shield 34 is enclosed in a common cable sheath 40.

Figure 6:
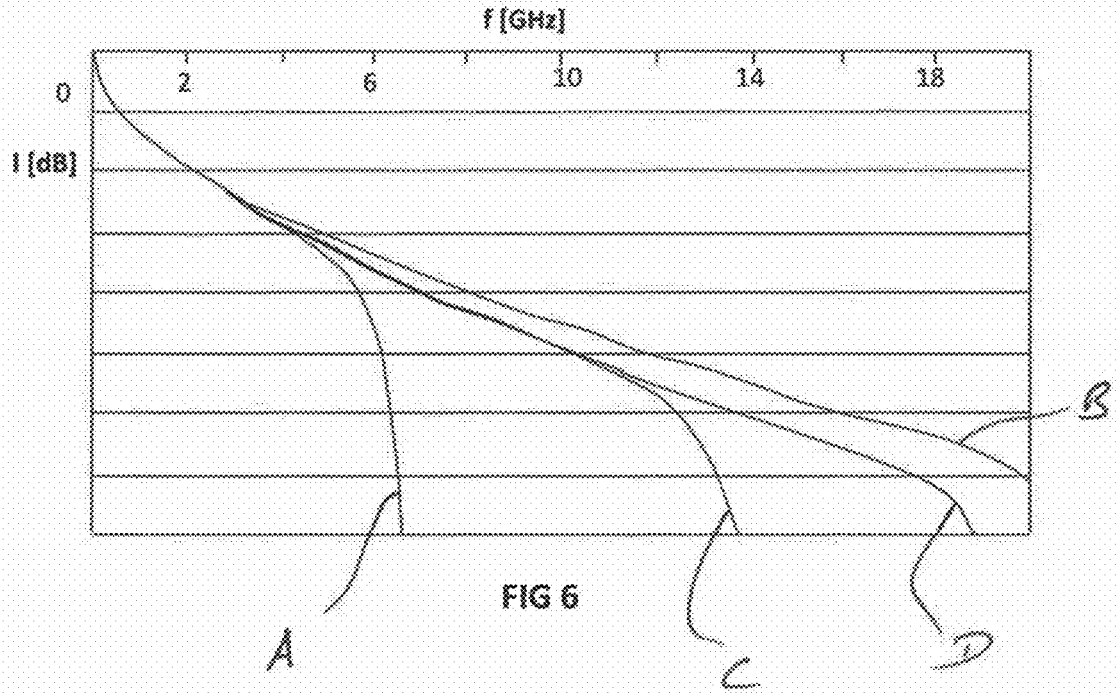
FIG. 6 is a diagram in which insertion damping I is plotted against frequency f in GHz for different pair shieldings in a symmetrical core pair.

FIG. 6 shows the "insertion damping" I of various shielded pairs of different types, plotted against the frequency f of the data signal being transmitted (in GHz). Curves A and B represent conventional embodiment variants. Curve A represents a shielded pair which is only surrounded by a single-layer shielding film. Conversely, curve B represents a shielded pair which is surrounded by a longitudinally folded shielding film.

Curve B also represents a characteristic trend for a winding variant in which the inner film 14 is wound with only a small overlap 26, as described heretofore.

Curve C is a characteristic curve for a variant associated, for example, with the shortest possible pitch of an Al-PET film, e.g. associated with the use of a 26 AWG (American Wire Gauge) wire. Through the use of an extremely short winding, the critical frequency can thus be displaced to a higher frequency band.

Curve D is a characteristic curve for the second variant described heretofore, in which the outer shielding film 16 is preferably wound in a gapped configuration, with a small clearance A on the order, for example, of approximately 3% of the width of the shielding film 16, as described with reference to FIG. 2. At the same time, the inner shielding film 14 is preferably wound with a large overlap 26 on the order, for example, of approximately 30% of its width.

It will clearly be seen that, in a conventional core pair with a wound pair shielding (curve A), insertion damping shows a steep increase with effect from a signal frequency of approximately 5 GHz. Accordingly, the suitability of a data cable of that type for higher signal frequencies is still conditional.

Conversely, a core pair 4 with a longitudinally folded shielding film (curve B), even at higher frequencies in excess of 5 GHz, shows a significantly smaller increase in damping, even in high-frequency ranges well in excess of 25 GHz. However, as mentioned at the outset, that is achieved at the expense of an unwanted increase in the "common mode signal."

Through the use of the special pair shielding 6 described herein, the insertion damping characteristic curve approximates more closely to the characteristic curve associated with a longitudinally folded pair shielding (curve B). A pair shielding 6 of this type, formed of the two shielding films 14, 16, even at higher frequencies in excess of 10 GHz, continues to show acceptable damping, so that a data cable 2 of this type is also suitable for the transmission of high-frequency data signals.

Overall, the special construction of the pair shielding 6 described herein delivers the following advantages: the resonance effect (which acts as a type of band-stop filter) is inhibited, or is at least displaced to a significantly higher frequency band. At the same time, the effective suppression of the common mode signal is achieved by the overlapping 26. Overall, the disadvantages of a longitudinally folded pair shielding are significantly reduced while, at the same time, the unwanted resonance effect associated with spiral-wound shieldings is at least extended to a non-disturbing frequency range in excess of 10 GHz, and preferably in excess of 15 or 20 GHz. Helical winding also permits simpler manufacture. In longitudinally folded pair shieldings, the formation of films is associated with a high degree of wear. Moreover, overlaps generate asymmetry and, overall, the flexibility of pairs is reduced by longitudinal films. Moreover, there are disadvantages associated with the production of longitudinal films. Thus, a dedicated individual unit is required for each individual set of dimensions.

The invention claimed is:

1. A data cable for high-speed data transmissions, the data cable comprising:

at least one core pair formed of two cores; and a film-shaped pair shielding defining a fully-enclosed shielding surrounding said at least one core pair, said pair shield including an inner shielding film and an outer shielding film, said inner and outer shielding films being in mutual electrical contact, said outer shielding film being wound around said inner shielding film with gaps, and said inner shielding film being wound around said at least one core pair with an overlap;

said inner shielding film has a width, and said overlap of said inner shielding film lies within a range between 20% and 40% of said width of said inner shielding film;

said outer shielding film has a width, and said gaps of said outer shielding film are each equal to between 1 and 10% of said width of said outer shielding film.

2. The data cable according to claim 1, wherein:

said at least one core pair includes a plurality of core pairs;

said pair shielding is one of a plurality of pair shieldings each surrounding a respective one of said core pairs; and each of said pair shieldings includes two respective shielding films.

3. The data cable according to claim 2, which further comprises fixing films each being wound around a respective one of said plurality of pair shieldings.

4. The data cable according to claim 2, which further comprises:

a cable core including a plurality of conductors;

said plurality of conductors each including a respective one of said core pairs and a respective one of said pair shieldings; and an outer shielding surrounding said cable core.

5. The data cable according to claim 1, wherein said cores are mutually parallel.

6. The data cable according to claim 1, wherein said inner shielding film is wound around said at least one core pair with no gaps.

7. The data cable according to claim 1, wherein at least said inner shielding film has a multi-layer configuration and includes a conductive layer and a substrate.

8. The data cable according to claim 1, wherein said inner and outer shielding films each have a respective conductive layer and a respective substrate, and said conductive layers face inwardly toward each other.

9. The data cable according to claim 1, wherein said outer shielding film and said inner shielding film are wound in opposite directions.

10. The data cable according to claim 1, which further comprises a wire bonded to at least one of said shielding films, said wire being disposed between said shielding films or outside of said outer shielding film.

11. The data cable according to claim 1, which further comprises a fixing film wound around said pair shielding.

12. The data cable according to claim 1, which further comprises:

a cable core including a plurality of conductors;

one of said conductors including said core pair and said pair shielding; and an outer shielding surrounding said cable core.

13. The data cable according to claim 1, wherein said inner and outer shielding films are two different films wrapped around said at least one core pair.

14. A data cable assembly for high-speed data transmissions, the data cable assembly comprising:

a cable core including a plurality of conductors;

said plurality of conductors each including a respective one of said core pairs and a respective one of said pair shieldings according to claim 1; and an outer shielding surrounding said cable core.

15. The data cable according to claim 1, wherein said inner shielding film is wound directly around said at least one core pair.

16. The data cable according to claim 1, wherein said inner shielding film is only one inner shielding film and said outer shielding film is only one outer shielding film.

* * * * *